US008186898B2

(12) United States Patent
Bradbury et al.

(10) Patent No.: US 8,186,898 B2
(45) Date of Patent: May 29, 2012

(54) PLURAL NOZZLE CLEANING IMPLEMENT

(75) Inventors: Glenn Allen Bradbury, Mason, OH (US); Keith David Fanta, Middletwon, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 940 days.

(21) Appl. No.: 12/229,487

(22) Filed: Aug. 22, 2008

(65) Prior Publication Data

US 2010/0043167 A1 Feb. 25, 2010

(51) Int. Cl.
*A47L 13/26* (2006.01)

(52) U.S. Cl. ..... 401/139; 401/25; 401/27; 401/137; 401/138; 401/140; 401/270; 15/228; 15/231; 15/320; 239/548; 239/543

(58) Field of Classification Search ..... 401/25, 401/27, 136–140, 270, 278, 279; 15/228, 15/231, 320, 322; 239/548, 722, 754, 543, 239/544

See application file for complete search history.

(56) References Cited

U.S. PATENT DOCUMENTS

| | | | |
|---|---|---|---|
| 3,219,276 | A | 11/1965 | Norris |
| 4,096,997 | A | 6/1978 | Larson |
| 4,977,927 | A | 12/1990 | Hill |
| 5,888,006 | A | 3/1999 | Ping |
| 5,960,508 | A | 10/1999 | Holt |
| 5,988,920 | A | 11/1999 | Kunkler |
| 6,003,191 | A | 12/1999 | Sherry |
| 6,048,123 | A | 4/2000 | Holt |
| 6,101,661 | A | 8/2000 | Policicchio |
| 6,142,750 | A | 11/2000 | Benecke |
| 6,206,058 | B1 | 3/2001 | Nagel |
| 6,217,889 | B1 | 4/2001 | Lorenzi |
| 6,237,704 | B1 | 5/2001 | Lay |
| 6,305,046 | B1 | 10/2001 | Kingry |
| 6,321,941 | B1 | 11/2001 | Argentieri |
| 6,328,543 | B1 | 12/2001 | Benecke |
| 6,380,151 | B1 | 4/2002 | Masters |
| 6,386,392 | B1 | 5/2002 | Argentieri |
| 6,467,983 | B2 | 10/2002 | Fodrocy |
| 6,484,346 | B2 | 11/2002 | Kingry |
| 6,491,069 | B2 | 12/2002 | Nagel |
| 6,540,424 | B1 | 4/2003 | Hall |
| 6,579,023 | B2 | 6/2003 | Kunkler |
| 6,595,712 | B2 | 7/2003 | Sickler |
| 6,601,261 | B1 | 8/2003 | Holt |
| 6,651,290 | B2 | 11/2003 | Kingry |

(Continued)

FOREIGN PATENT DOCUMENTS

WO WO 2006/097957 A 9/2006

OTHER PUBLICATIONS

PCT International Search Report, 5 Pages, Mailed Mar. 12, 2009.

*Primary Examiner* — Steven J Ganey

(74) *Attorney, Agent, or Firm* — Larry L. Huston; Leonard W. Lewis; Steven W. Miller

(57) ABSTRACT

A plural nozzle cleaning implement. The nozzles are oriented inwardly, to provide a converging spray pattern. The converging spray pattern provides more coverage of the target surface, which increases residence time of fluid sprayed onto debris.

17 Claims, 3 Drawing Sheets

U.S. PATENT DOCUMENTS

| | | | | |
|---|---|---|---|---|
| 6,655,866 | B1 | 12/2003 | Morad | |
| 6,659,670 | B1 | 12/2003 | Blouse | |
| 6,663,306 | B2 | 12/2003 | Policicchio | |
| 6,722,806 | B2 | 4/2004 | Kunkler | |
| D489,537 | S | 5/2004 | Wong | |
| 6,797,357 | B2 | 9/2004 | Fereshtehkhou | |
| 6,814,519 | B2 | 11/2004 | Policicchio | |
| D499,887 | S | 12/2004 | Wong | |
| 6,842,936 | B2 | 1/2005 | Policicchio | |
| 6,936,330 | B2 | 8/2005 | Fereshtehkhou | |
| 6,953,299 | B2 | 10/2005 | Wang | |
| 6,964,535 | B2 | 11/2005 | Bell | |
| 6,976,802 | B2 | 12/2005 | Hall | |
| 7,004,658 | B2 | 2/2006 | Hall | |
| 7,172,099 | B2 | 2/2007 | Hofte et al. | |
| 7,187,537 | B2 | 3/2007 | Liao | |
| 7,264,413 | B2 | 9/2007 | Vosbikian | |
| 7,761,954 | B2 * | 7/2010 | Ziegler et al. | 15/320 |
| 2003/0072603 | A1 * | 4/2003 | DeLaine, Jr. | 401/137 |
| 2006/0222441 | A1 * | 10/2006 | Tanaka et al. | 401/139 |

* cited by examiner

PLURAL NOZZLE CLEANING IMPLEMENT

FIELD OF THE INVENTION

The present invention relates to cleaning implements and more particularly to cleaning implements for dispensing a fluid.

BACKGROUND OF THE INVENTION

Cleaning implements are well known in the art. Particularly, floor cleaning implements have been used which dispense a fluid onto the target surface. The fluid solublizes debris on the floor for later scrubbing and/or removal from the floor.

Fluids sprayed from a cleaning implement include any fluid usable to treat a target surface. Typical fluids include cleaning fluids, disinfectants, perfumes, etc. A suitable cleaning fluid may be made according to commonly assigned U.S. Pat. No. 6,380,151.

Upon wetting the target surface with the fluid, the user may remove debris with a disposable cloth. The cloth may be removably attached to the head, and particularly to the underside of the head. Suitable cloths include nonwovens, microfiber, yarns, formed polymeric films, superabsorbent gelling materials; compostable materials, such as PLA, combinations thereof, etc. Suitable cloths may be made according to the teachings of commonly assigned U.S. Pat. Nos. 6,797,357; 6,936,330; D489,537; D499,887; 5,960,508; 6,003,191; 6,048,123; 6,101,661 and/or 6,601,261.

The cloth may be disposable, i.e. discarded after being soiled. A disposable cloth may be discarded after a single use. Alternatively, the cloth may laundered and restored, for subsequent reuse. After subsequent reuse, the disposable cloth may then be discarded.

The cloth may be removably attached to the head using hook and loop fasteners, resiliently deformable grippers, adhesive, cohesion, spring loaded clips, etc. Suitable grippers may be made according to the teachings of commonly assigned U.S. Pat. Nos. 6,305,046; 6,484,346 and/or 6,651,290.

Cleaning implements which dispense fluid from a single nozzle are well known in the art, as illustrated by commonly assigned U.S. Pat. Nos. 5,888,006; 5,988,920; 6,206,058; 6,217,889; 6,386,392; 6,663,306; 6,722,806 and 7,172,099. When using a single nozzle, typically the fluid spray pattern diverges as fluid is expelled from the nozzle. The typical pattern sprayed from a single nozzle cleaning implement is a fan or cone shape.

The art also includes plural nozzle implements, as illustrated by U.S. Pat. Nos. 3,219,276; 6,540,424; 6,595,712; 6,976,802 and 7,264,413. One supposed benefit of plural nozzles is that such an embodiment can provide a more advantageous spray pattern of the fluid on the target surface. A review of the art, such as the aforementioned '802 patent, however, shows that a diverging cone or fan shaped spray pattern is also taught in conjunction with plural nozzle implements.

A cone or fan shaped spray pattern provides the disadvantage that debris in the regions of the target surface not covered by the spray cannot be solublized. When the debris is not solublized, it can be more difficult to remove during the cleaning process. This problem occurs when there is no or only minimal residence time of the cleaning fluid on the debris.

Furthermore, plural nozzles can provide the disadvantage that uneven flow can provide an uneven spray pattern. And if any nozzle of the plurality should drip or dribble when flow is intended to be terminated, an unsightly trace amount of fluid may be deposited. The trace fluid must then be cleaned, to prevent a slipping hazard or simply an unsightly appearance before drying.

Attempts to control trace fluid deposition from plural nozzles include using gravity flow, and various check valves. Check valves having plural flow outlets are illustrated by U.S. Pat. Nos. 4,096,997; 4,977,927 and 6,237,704.

Despite these efforts in the art, there remains the opportunity to improve the use of plural nozzles and the flow of cleaning fluid therefrom.

SUMMARY OF THE INVENTION

The invention comprises a head for a cleaning implement. The head may have a longitudinal centerline and comprise a front edge having a width. The width is divisible into four quadrants, two outer quadrants and two inner quadrants therebetween. One of the inner quadrants and one of the outer quadrants is disposed on each side of said longitudinal centerline. At least two nozzles are juxtaposed with the front edge of said head, one said nozzle being disposed in each outer quadrant of said head. Each said nozzle may be oriented towards the longitudinal centerline to spray a fluid towards the centerline.

DETAILED DESCRIPTION OF THE INVENTION

Figure 1A:
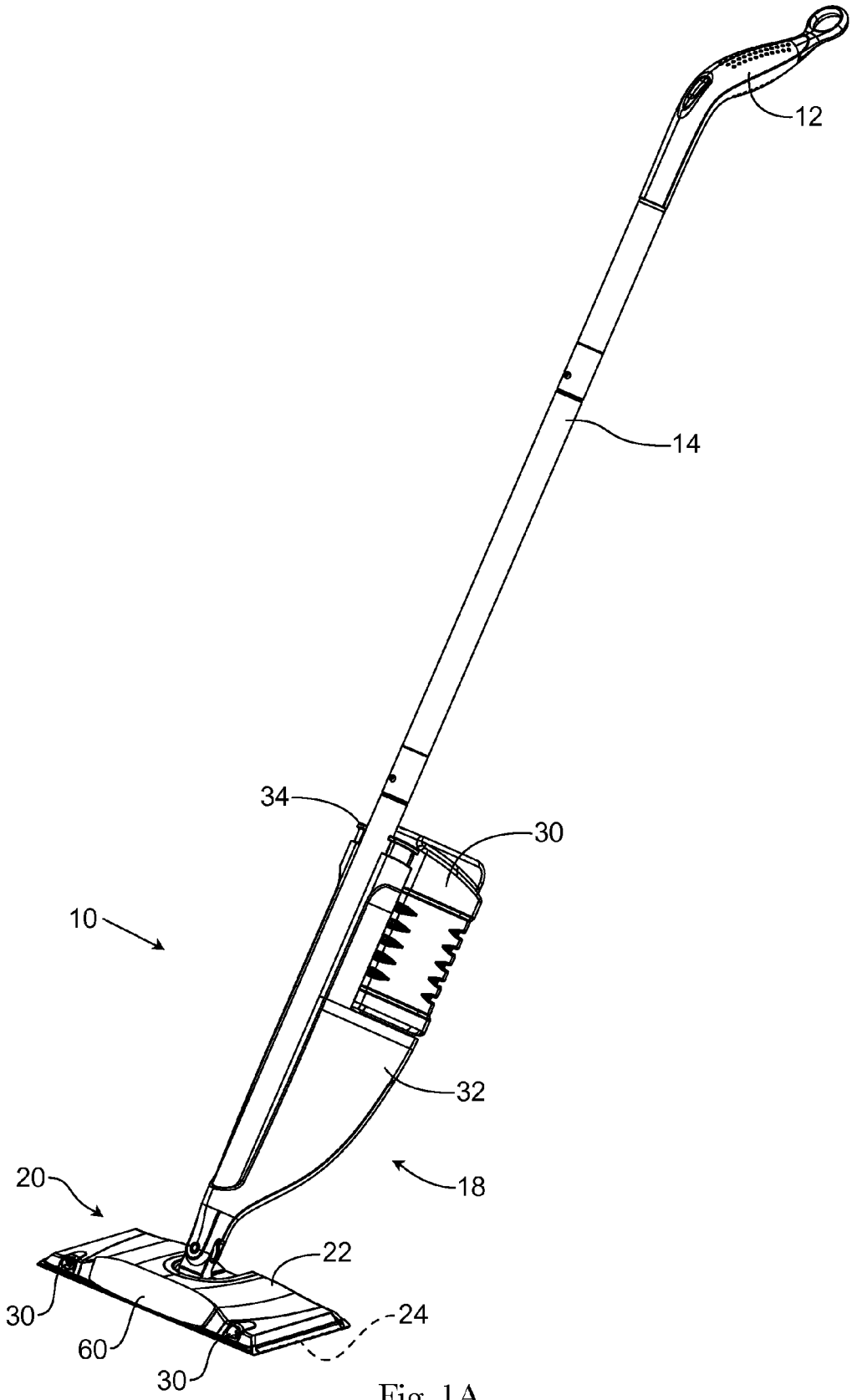
FIG. 1A is a perspective view of a cleaning implement according to the present invention.
Figure 1B:
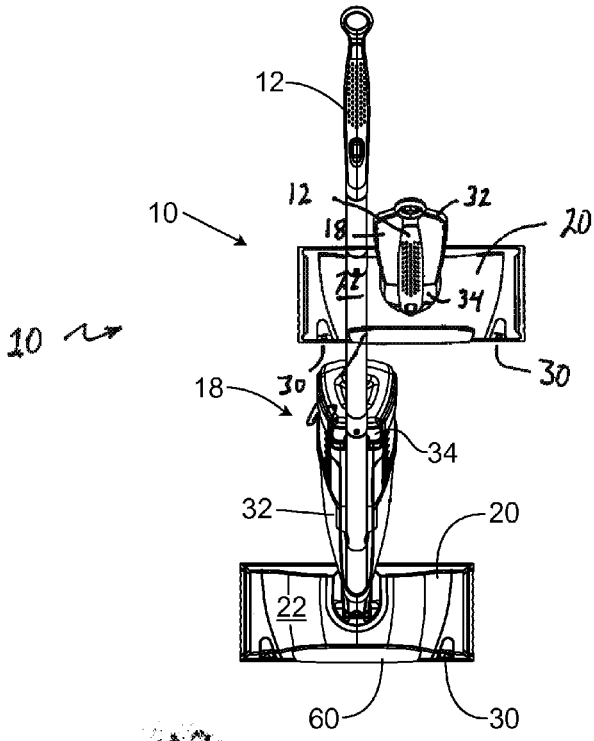
FIG. 1B is a top plan view of the cleaning implement of FIG. 1A, having the reservoir omitted for clarity.

Referring to FIGS. 1A and 1B, the cleaning implement 10 according to the present invention may comprise a head 20, a handle 12 and a pole 14 therebetween. The pole 14 and head 20 may be connected by a u-joint, as is known in the art. The implement 10 may further comprise a body 18 mounted on the pole 14 as shown, or the components of the body 18 may be integrated into the head 20. The implement 10 may optionally comprise a suction nozzle and vacuum (not shown) for collecting debris removed from the target surface.

The head 20 may comprise attachments for removably receiving a cleaning sheet. The head 20 and or body 18 may comprise a reservoir 30 for receiving a fluid to treat the target surface and other components as may be helpful. The body 18 may comprise a pump, a motor therefor, batteries to power the motor if line current is not used, or an inlet for the power cord if line current is utilized, and other components as may be helpful. There is also provision for communication of control signals between the head 20 and body 18. One embodiment for providing signal communication is illustrated in commonly assigned U.S. Pat. No. 6,579,023.

The handle 12 may provide for ergonomic manipulation of the implement 10. An on-off switch may be disposed on the handle 12, body 18, head 20 or pole 14. While an implement 10 suitable for a standing user is illustrated, the invention is not so limited. The pole 14 may be shortened or eliminated, and/or the handle 12 configured for hand-held ergonomics or for use on one's hands and knees.

As used herein horizontal refers to the primary direction of the movement of the head 20 of the implement 10 along a horizontal target surface and which occurs within the plane of the target surface. Vertical refers to the direction perpendicular to the target surface and horizontal direction, and which spaces apart the top surface 22 and bottom surface 24 of the head 20. The width of the implement 10 refers to the left-right direction during use. The front-back direction is perpendicular thereto and parallel to the target surface. The implement 10 may have a longitudinal centerline which divides the implement 10 into two halves, in the front-back direction.

Examining the components in more detail, the head 20 may comprise a generally upwardly facing top surface 22 and a bottom surface 24 opposed thereto. The head 20 may have a front edge. The width of the front edge of the head 20 is defined by two side edges, with one side edge being disposed on each side of the longitudinal centerline. The width of the front edge may be divided into four quadrants, two inboard quadrant and two outboard quadrants, with one inboard quadrant and one outboard quadrant being disposed on each side of the longitudinal centerline. The head 20, and particularly the bottom surface 24 thereof, may move relative to the target surface to be cleaned.

The target surface may be a floor, and more particularly a hard surface floor, such as tile, hardwood, linoleum, etc. A cleaning sheet may be attached to the bottom surface 24, using attachments as are known in the art.

Exemplary attachments include deformable grippers, etc. Deformable grippers may be used to attach the cleaning sheet, because such an attachment works with a variety of sheet materials, does not require extra manufacturing steps in the sheet (such as the addition of adhesive) and may last for the life of the implement 10. While uniform and substantially identical attachments are typically used, the invention is not so limited. The attachments may comprise two or more different attachment types. Three or more attachments may be used. If four attachments are utilized, they may be disposed in a rectangular pattern comprising two front attachments and two rearward attachments. One or more of the attachments may be disposed on the top surface 22 of the head 20 and generally face away from the bottom surface 24 of the head 20 and target surface during cleaning. This disposition of attachments provides the benefit of convenient access thereto.

Alternatively or additionally, the attachments may comprise a hook and loop system as is known in the art. The bottom of the head 20 may be totally or partially covered with hooks. The cloth may comprise loops. By engaging the hooks into the loops, the cloth may be releasably attached to the head 20. If desired, the implement 10 may further comprise an adapter plate to allow different sizes and types of cloths to be utilized, as illustrated by commonly assigned U.S. Pat. No. 6,842,936.

The reservoir 30 may be detachable and replaced as the contents are depleted. A reservoir 30 may be removably attached to the implement 10 using a dedicated sleeve 32. The reservoir 30 may be inverted and inserted into the sleeve 32, so that fluid flows from the reservoir 30. Alternatively, the reservoir 30 may be may be permanently attached to the implement 10 and refilled as necessary.

If a dedicated sleeve 32 is utilized, the sleeve 32 may have a release 34. The release 34 allows the reservoir 30 to be removed from the sleeve 32 when the contents are depleted or as otherwise desired. The release 34 may be disposed on the top of the sleeve 32. This position provides for ergonomic convenience, so that manipulation of the release 34 does not require the user to bend over to reach the lower portions of the implement 10.

The release 34 may serve as a push button mechanism, or other releasable latching mechanism, to allow removal of the bottle or other reservoir device from the sleeve 32. As the consumer pushes down on the push button, or other latch mechanism of the release 34, such downward motion is converted to a lateral motion of a moving member. The moving member engages a complementary portion of the reservoir in a first position and disengages from such portion in a second position. The manipulation of the release 34 engages and disengages the moving member from the complementary portion of the reservoir.

While a single reservoir 30 is shown, one of skill will recognize the invention is not so limited. The implement 10 may comprise plural reservoirs 30. The plurality of reservoirs 30 may contain the same fluid therein, thus providing greater quantity than a single reservoir 30. Alternatively, the reservoirs 30 may comprise different fluids. The different fluids may be dispensed sequentially, or a particular fluid may be dispensed as needed for a particular task. If the reservoirs 30 comprise different fluids, the fluids may be co-dispensed, to allow mixing at the point of use on the target surface.

Fluid may be dispensed from the reservoir 30 using a manual pump. Such a reservoir 30 may be disposed on the head 20 and the pump controlled remotely from the handle 12 or pole 14, as illustrated in U.S. Pat. Nos. 6,467,983; 6,655,866 and/or 6,659,670.

If desired, fluid may be dispensed from the reservoir 30 using an automatic pump. An automatic pump is driven by a motor. The motor is powered from an external source, such as batteries, line current, etc. The batteries and/or pump may be disposed in the head 20, body 18, elsewhere on the pole 14 or combinations thereof. For example, the batteries may be disposed on the body 18, while the motor and pump are disposed on the head 20, or all three components may be disposed on the body 18 or head 20. An implement 10 having a replaceable reservoir 30 and powered pump may be made according to the teaching of commonly assigned U.S. Pat. Nos. 5,888,006; 5,988,920; 6,142,750; 6,206,058; 6,321,941; 6,328,543; 6,386,392; 6,491,069; 6,579,023; 6,814,519; 6,842,936; 7,172,099 and/or 7,187,537.

Alternatively, fluid may be dispensed from the reservoir 30 using a gravity fed system. A gravity fed implement 10 may have the reservoir 30 mounted above and in fluid communication with one or more spray nozzles 30. Fluid flows from the reservoir 30 to the nozzles 30 under the influence of gravity. The flow may be controlled by shutoff valves, as is known in the art. A gravity fed implement 10 having plural nozzles 30 may be made according to the teachings of U.S. Pat. Nos. 6,540,424; 6,953,299; 6,964,535 and/or 7,004,658.

The fluid may flow from the reservoir 30 though a flow path to the plurality of nozzles 30 for dispensing onto the target surface. A check valve 40 may be disposed in the flow path. The check valve 40 may have a single inlet 42 and plural outlets 44. The inlet 42 may receive fluid from the reservoir 30. The outlets 44 may provide the fluid to the nozzles 30.

If desired, each nozzle 30 may have a dedicated outlet 44 from the check valve 40. Alternatively, a plurality of outlets 44 may feed into a single nozzle 30 or one outlet 44 may feed plural nozzles 30. For example, each nozzle 30 may have a dedicated check valve 40. However, this arrangement has the disadvantage that unless the check valves 40 have identical operating characteristics, a non-uniform spray pattern and dribbling from one nozzle 30 (due to backflow from the other nozzle 30) may result.

Figure 3A:
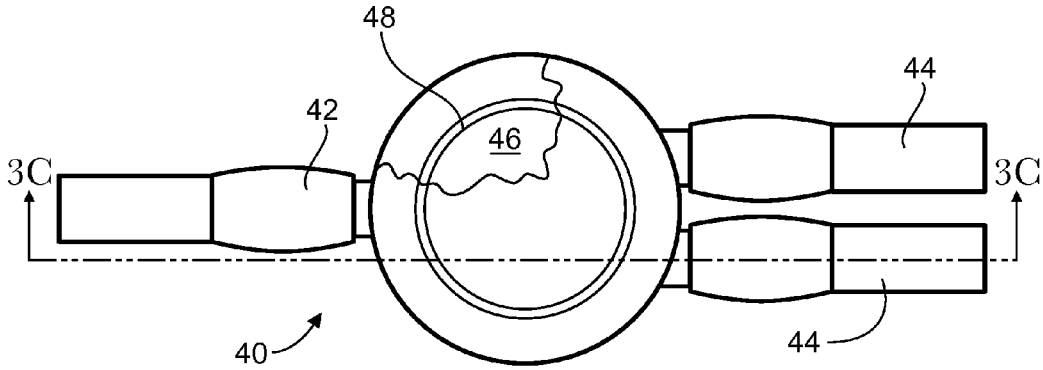
FIG. 3A is a top plan view, shown partially in cutaway, of an exemplary single inlet, dual outlet check valve.
Figure 3B:
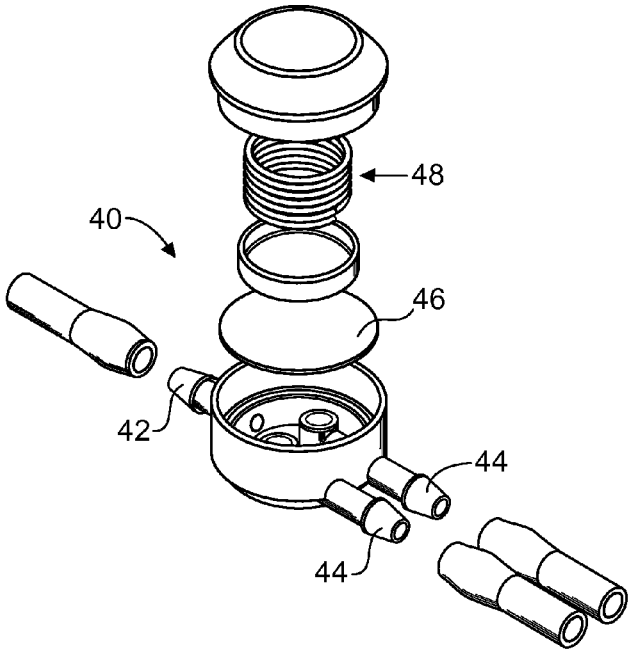
FIG. 3B is an exploded perspective view of the dual outlet check valve of FIG. 3A.
Figure 3C:
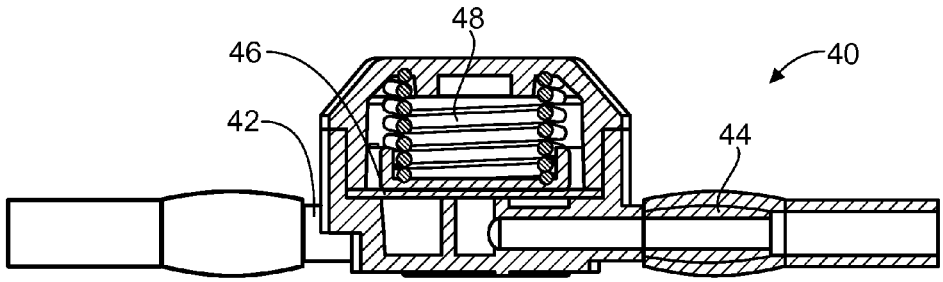
FIG. 3C is a sectional view taken along Line 3C-3C of FIG. 3A.

Referring to FIGS. 3A, 3B and 3C, the check valve 40 may comprise a diaphragm 46 disposed intermediate the inlet 42 and outlets 44. The diaphragm 46 may be biased against the direction of fluid flow. A spring 48 may provide the biasing force, as is known in the art. The force of the fluid flow overcomes the spring 48 force, allowing fluid to flow from the inlet 42, past the diaphragm 46, to the plurality of outlets 44.

When the fluid flow is shut off the spring 48 returns the diaphragm 46 to the closed position. In the closed position, air and fluid from the reservoir 30 cannot communicate between the nozzles 30. The absence of communication between the nozzles 30 is due to the blockage provided by the closed diaphragm 45 therebetween. The blockage minimizes air flow through one nozzle 30, which, in turn, minimizes the flow of fluid from another nozzle 30.

Referring back to FIGS. 1A and 1B, the implement 10 may comprise a plurality of nozzles 30. The nozzles 30 are shown to be disposed onto the head 20 of the implement 10. However, one of skill will recognize the invention is not so limited. The nozzles 30 may be mounted onto the handle 14, body 18, head 20 or a combination thereof. If the nozzles 30 are disposed on the head 20 of the implement 10, the nozzles 30 may be juxtaposed with the front face thereof. If the nozzles 30 are disposed on the front face of the head 20, the nozzles 30 may be recessed behind the front face. This arrangement provides the benefit that the nozzles 30 are protected if the front edge of the implement 10 should strike a wall or other solid object.

Each nozzle 30 may be oriented at a particular azimuthal angle relative to the longitudinal centerline and/or the horizontal plane. The orientation of a nozzle 30 is determined by the orientation of the centerline of that nozzle 30. At least one nozzle 30 may be disposed on each side of the longitudinal centerline, and spaced equally therefrom.

Each nozzle 30 may be oriented towards the longitudinal centerline and spray fluid forward and towards the respective opposite side edge. The spray pattern of the fluid may be contained within the width of the head 20, if the spray from each nozzle 30 remains within a theoretical forward extension of the respective opposite side edge. Further each nozzle 30 may have an included spray angle for depositing the desired spray pattern. Each nozzle 30 may be oriented towards the longitudinal centerline at an angle of at least 10, 15 or 20 degrees, but not more than 30, 25 or 20 degrees. A nozzle 30 may have a symmetric included spray angle of at least 40, 50 or 60 degrees, but not more than 80, 70 or 60 degrees. Each nozzle 30 may be oriented not more than plus or minus 10, 5 or zero degrees relative to the horizontal.

Figure 2A:
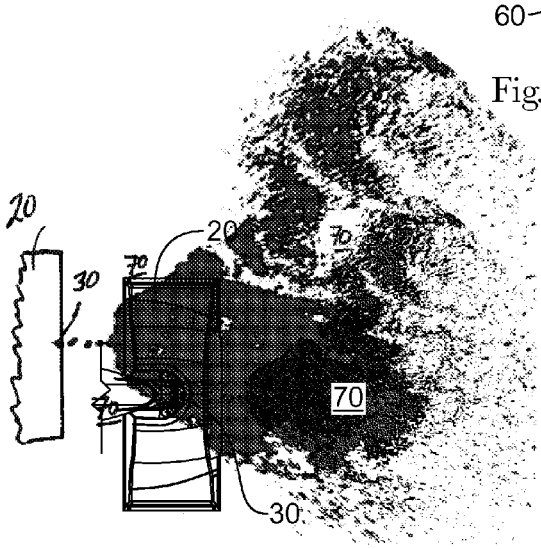
FIG. 2A (prior art)
FIG. 2A is a top plan view of an exemplary spray pattern, from left to right, as sprayed from a single nozzle cleaning implement according to the prior art.

Referring to FIG. 2A, one spray pattern according to the prior art has considerable dry area 70 between the head 20 and where the fluid contacts the target surface. Some dribble between the nozzle 30 and continuous spray pattern is evident. Also evident are two large generally triangular dry areas outside the main flow pattern.

Figure 2B:
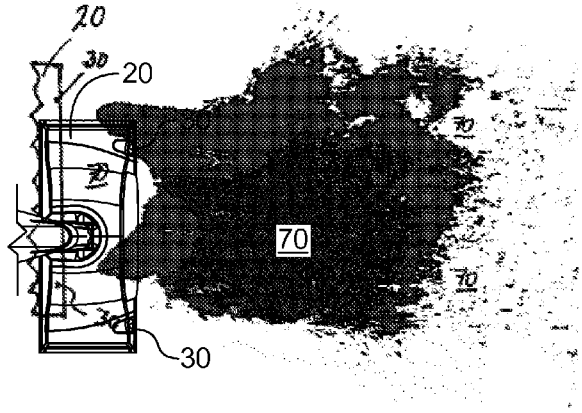
FIG. 2B is a top plan view of an exemplary spray pattern, from left to right, as sprayed from a dual nozzle cleaning implement according to the present invention.

Referring to FIG. 2B, one spray pattern according to the present invention has a triangular dry area 70 between the head 20 and where the fluid contacts the target surface. Two relatively small generally triangular dry areas outside the main flow pattern are evident.

Comparing FIGS. 2A and 2B, one can see a large fluid distribution pattern, and hence greater area covered, by the spray pattern according to the present invention. The increased coverage provides more residence time, and hence more solublization, of fluid on the areas covered by the present invention.

As a non-liming prophetic example, in implement 10 may be provided having two nozzles 30 oriented at about 40-45 degrees relative to the longitudinal centerline. Each nozzle may have an included angle of spray of about 80-85 degrees and spray forward a distance of at least about 50 cm. Such an arrangement might prophetically provide the uniform spray pattern which provides relatively greater residence time for more debris on the target surface. The nozzle geometry may be adjusted to prevent spray from intercepting the front face of the head 20.

Referring back to FIG. 2B, one nozzle 30 may be disposed on each outboard quadrant of the front face of the head 20. This arrangement provides a geometry where the nozzles 30 are spaced apart, as measured between nozzle 30 orifices, a distance of at least 15, 20, 25, 30, 35, 40, 45, 50, 55 or 60 cm or more. Such a geometry provides the benefit of more area coverage by fluid sprayed from the pair of nozzles 30. Additionally, one or more nozzles 30 may be juxtaposed with or coincident the longitudinal centerline. Thus, a symmetric spray pattern implement 10 may have two nozzles 30, one disposed on each side of the longitudinal centerline, three nozzles 30 if a nozzle 30 is added to the longitudinal centerline, four nozzles 30 if two are disposed on each side of the longitudinal centerline, five nozzles 30 if one is added to the longitudinal centerline, etc.

If desired, each nozzle 30 may have an asymmetric spray pattern. The asymmetric pattern may provide greater spray near the outer edges of the head 20 than near the longitudinal centerline. Such a nozzle may have an asymmetric opening, allowing greater flow to occur juxtaposed with the outer edges of the spray pattern. This distribution of the spray may prophetically provide a visual cue to the user where the boundaries of the spray hit the target surface. If the boundaries of the spray generally correspond to the width of the head 20, the user may prophetically have the added convenience of cleaning a more uniform distribution of cleaning fluid directly in front of the head 20 and on the area sought to be cleaned.

This differential spray pattern provides the benefit that the heavier deposition of fluid near the outer edges along the width of the head 20 provides a visual clue to the user where the fluid is deposited. By depositing the fluid where debris is disposed on the target surface, the user can spray more fluid on such debris, and increase the residence time of such fluid on the debris. The spray pattern may be determined by placing the implement 10 on a horizontal surface and disposing a piece of brown kraft paper in front of the implement 10. The spray is deposited on the kraft paper and the spray pattern determined by the darkened/wetted regions thereof.

If desired, the implement 10 may further comprise an abrasive patch 60. The abrasive patch 60 may comprise any material which acts to remove debris without damaging the target surface. Such a patch 60 may comprise a blend of adhesively bonded nylon and polyester fibers, as is known in the art.

The patch 60 may be disposed on the head 20 of the implement 10. If desired, the patch 60 may be disposed on the front face of the implement 10. This arrangement provides the advantage that if the head 20 is inverted, the abrasive patch 60 is downwardly oriented and may be used to scrub debris from the target surface. Further, if the converging spray pattern is utilized with the front face-mounted abrasive patch 60, the nozzles 30 will spray towards the debris disposed on the target surface. This process provides the benefit of providing both a fluid spray and scrubbing action to remove debris from the target surface.

The abrasive patch 60 may be removably or permanently attached to the head 20 of the cleaning implement 10. If the abrasive patch 60 is removably attached to the cleaning implement 10, the abrasive patch 60 may be removably attached using adhesive, hook material, etc., as is known in the art.

The abrasive patch 60 may have a width of at least 50, 60, 70, 80, 90 or 100 percent of the width between the two nozzles 30 disposed on the front face of the head 20 or of the total width of the head. This geometry provides an advantageous system for removal of debris from the target surface.

In another embodiment (not shown), the plural nozzles 30 may be mounted on a cross-bar which is disposed on the pole 14. The cross bar may be an integral part of the sleeve 32. The cross bar may space the plural nozzles 30 apart, so that the same orientation described hereinabove and claimed hereinbelow is achieved. Such an embodiment is considered to be a juxtaposition or disposition of such nozzles 30 on the head 20.

The dimensions and other values disclosed herein are not to be understood as being strictly limited to the exact numerical values recited. Instead, unless otherwise specified, each such value is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A head for a cleaning implement, said head having a longitudinal centerline and comprising:

A front edge having a width, said width being divisible into four quadrants, two outer quadrants and two inner quadrants therebetween, one of said inner quadrants and one of said outer quadrants being disposed on each side of said longitudinal centerline; and at least two nozzles juxtaposed with said front edge of said head, one said nozzle being disposed in each outer quadrant of said head, each said nozzle being oriented towards said longitudinal centerline to spray a fluid theretowards.

2. A head according to claim 1 wherein said width is defined by two opposed edges and further comprising a means for spraying a fluid from each of said nozzles towards the respective opposed edge, wherein said spray from said nozzle remains within said width defining said edges.

3. A head according to claim 2 wherein said nozzles have an included spray angle of 70 to 80 degrees.

4. A head according to claim 3 wherein said nozzles are oriented at an angle of 20 to 30 degrees relative to said longitudinal centerline.

5. A head according to claim 3 wherein said nozzles are oriented at an angle of 0 to minus 5 degrees relative to the horizontal plane when said head is placed on a horizontal surface.

6. A head according to claim 4 having a front face, wherein each said nozzle is recessed from said from front face.

7. A head according to claim 2 wherein each said nozzle has an asymmetric spray pattern, said asymmetric spray pattern providing a greater spray near said respective edge and a lesser spray near the longitudinal centerline.

8. A head according to claim 2 having a front face and further comprising an abrasive patch removably attached to said front face of said head and disposed between said two nozzles.

9. A head according to claim 8 wherein said abrasive patch has a patch width, said patch width being from 70 to 100 percent of said width of said front edge of said head.

10. A head for a cleaning implement, said head having a front edge, two opposed side edges, a longitudinal centerline and comprising:

at least two nozzles, one said nozzle being disposed on each side of said longitudinal centerline of said head, each said nozzle being oriented towards said longitudinal centerline to spray a fluid towards and across said longitudinal centerline and towards said respective opposed side edge, wherein each said nozzle sprays with an outboard fluid deposition oriented towards the respective side edge of that nozzle and a centerline deposition oriented towards the centerline of said head, each said outboard deposition being greater than each said centerline deposition.

11. A head according to claim 10 wherein said nozzles are spaced apart a distance of at least 15 cm.

12. A head according to claim 11 having a head width wherein said spray is confined to be within said head width.

13. A head according to claim 12 wherein said spray is directed forward of said front edge of said head a distance of at least about 50 cm.

14. A head according to claim 11 further comprising a third nozzle, said third nozzle being juxtaposed with said longitudinal centerline.

15. A cleaning device having a longitudinal centerline and a transverse width perpendicular thereto, said device comprising:

a head for contactingly cleaning a target surface;

a reservoir for dispensing fluid to a plurality of transversely spaced apart nozzles through a flow path in fluid communication from said reservoir to each said nozzle;

a check valve disposed in said flow path, said check valve having a single inlet from said reservoir and a plurality of outlets, one said outlet being in communication with a respective said nozzle, said check valve preventing fluid flow from any said nozzle to the another said nozzle.

16. A device according to claim 15 wherein said check valve has an operationally biased diaphragm intermediate said inlet and said outlets.

17. A device according to claim 16 further comprising a powered pump, said pump dispensing fluid from said reservoir through said check valve to each of said nozzles.

* * * * *